United States Patent [19]

Jimenez et al.

[11] Patent Number: 4,945,844

[45] Date of Patent: Aug. 7, 1990

[54] SEWING MACHINE

[75] Inventors: Antonio Jimenez, Meyrin; Pierre-Alain Deschenaux, Coinsins, both of Switzerland

[73] Assignee: Mefina SA, Fribourg, Switzerland

[21] Appl. No.: 353,750

[22] Filed: May 18, 1989

[30] Foreign Application Priority Data

May 27, 1988 [CH] Switzerland ..... 2037/88

[51] Int. Cl.[5] ..... D05B 3/02

[52] U.S. Cl. ..... 112/444; 112/445; 112/258

[58] Field of Search ..... 112/444, 445, 453, 458, 112/258, 259; D15/69, 76

[56] References Cited

U.S. PATENT DOCUMENTS

| | | | |
|---|---|---|---|
| 4,079,683 | 3/1978 | Hanyu et al. | 112/444 |
| 4,335,667 | 6/1982 | Becker | 112/445 |
| 4,343,248 | 8/1982 | Hanyu et al. | 112/445 |
| 4,677,924 | 7/1987 | Diener et al. | 112/444 X |

*Primary Examiner*—Peter Nerbun

*Attorney, Agent, or Firm*—Cushman, Darby & Cushman

[57] ABSTRACT

An electronic sewing machine comprises two tables of ideograms corresponding to the patterns capable of being sewn by the machine. One of these tables is carried by the front face of the casing of the machine and the other by the bottom of a pivoting cover capable of occupying two end positions. One of these end positions is a raised end position, in which the user may view the ideograms of the cover, and the other is a lowered end position, in which the cover is closed over on the casing of the machine and covers up the first of the tables of ideograms, the second also being likewise out of sight.

4 Claims, 3 Drawing Sheets

SEWING MACHINE

BACKGROUND OF THE INVENTION

1. Description of the Prior Art

U.S. Patent Specification No. 4,343,248 relates in particular to a sewing machine whose casing has a lower arm, an upper arm and a pillar connecting these arms, in which at least a part of the front surface of the upper arm carries a first plurality of ideograms characteristic of a corresponding number of different stitches capable of being carried out by the machine. The upper arm has a cover pivotingly mounted about an axis substantially parallel to the longitudinal axis of the upper arm and is capable either of being shut down onto this arm or of being brought into a raised position, distant from the upper arm. At least a part of the internal surface of the cover, which is visible from the front of the machine when the cover is in the raised position, carries a second plurality of ideograms representative of other stitches capable of being carried out by the machine.

In this type of machine, the cover is mounted in such a manner that, in the turned down position when the machine is not in use, it only covers a portion of the length of the upper face of the arm on which it is hinged. This arrangement allows the viewing of the set of ideograms appearing on the front surface of the frame of the machine even when the cover is in the turned down position.

BRIEF SUMMARY OF THE INVENTION

The present invention proposes to overcome this disadvantage with the aims of protecting the ideograms and, at the same time, of assuring an acceptable aesthetic appearance for the machine while it is not in use.

Accordingly, the invention provides a sewing machine of the type described above, characterized by the fact that the pivoting axis of the cover is disposed in such a way that when the cover is brought into its shut down position on the upper arm of the casing of the machine, it covers up the ideograms carried by this arm.

Advantageously, and when the ideograms of the cover are arranged in at least two parallel rows, the cover has a flap hinged between the rows of ideograms which is capable of being folded back onto the bottom of the cover in two end positions of pivoting so as to cover up one or the other of the said rows of ideograms, according to the end position of pivoting of this flap. The two surfaces of this flap each carry at least another row of ideograms relating to sewing stitches capable of being carried out by the sewing machine.

BRIEF DESCRIPTION OF THE DRAWINGS

The accompanying drawings show, by way of example, an embodiment of the subject of the present invention.

DETAILED DESCRIPTION OF THE INVENTIONS

Figure 1:
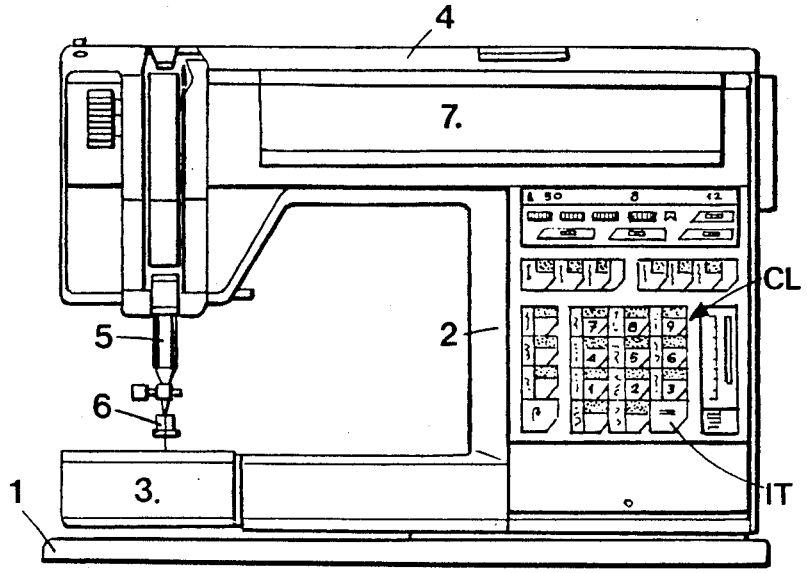
FIG. 1 is a view in elevation.

The sewing machine illustrated in FIG. 1 comprises a base 1 on the right hand part of which stands a pillar 2 carrying two horizontal arms 3 and 4. The lower horizontal arm 3 incorporates in particular, a cloth feed device, a loop pick-up device, and a drive and control mechanism for these components (none of which components are shown). The upper horizontal arm 4 carries, in particular, a needle bar 5, a drive mechanism (not shown) for bar 5, and a presser foot 6.

The sewing machine is an electronic machine of the microprocessor type. More particularly a machine in which the instructions necessary for the control of the needle, of the feed device for the cloth to be sewn, and of the loop pick-up device are stored in digital form in one or more electronic memories, ROM, PROM, RAM, etc. The instructions are read by the microprocessor on which the control of all of the functions of the machine depends.

The instructions may, in particular, relate to the carrying out of different types of sewing patterns, which the user may preselect individually with a view to their being subsequently carried out. A keyboard CL, of 10 keys, marked 0 to 9, is provided for activating the selected sewing pattern. EAch key of the keyboard represents a digit of a value corresponding to that of the number which it carries and by selectively operating the keys and an insertion key 1T one of the aforementioned memories can be accessed.

By means of keyboard CL, it is possible to input into memory numbers of one, two or three digits whose values are characteristic of a specific type of sewing pattern capable of being carried out by the sewing machine. Such a machine is in effect capable of sewing as many as 999 different patterns, on condition of course that the memory or memories with which it is equipped comprise the corresponding sewing instructions.

It may be noted, on this point, that an electronic machine of the type represented may very well comprise an integrated memory of sufficient capacity to store the instructions necessary for the carrying out of the 999 patterns mentioned. Such a memory would however be both bulky and delicate. Preferably, an integrated memory of medium size is provided, which is capable of containing a limited number of instructions. For example, a mememory capable of storing about 200 patterns can be provided and complementary or additional memories, of a type that can be slotted into the machine, as for example is the case of the "Symphony 300" sewing machine sold by Singer or the Elna (Trade Mark) 7000 machine can also be provided. It is possible, for example, to provide that each cassette has an additional memory containing instructions for approximately a hundred sewing patterns.

However, it is not enough to be able to offer the user the possibility of sewing several hundred different patterns with the same machine. This user must also be able to rapidly recognize and without error, the nature of the various patterns capable of being carried out, and, determine for each of them the one, two or three digit access code, depending on the type of pattern in question.

As is known, here lies one of the major problems of the type of machine adverted to above, because a simple identification of each pattern is only possible, for the user, if there is at his/her disposal actual "tables" giving, for a given pattern, both a sufficiently true representation of this pattern and also its corresponding code, which must be input into memory by activation of the keyboard CL. The above tables are generally printed on or attached to the casing itself of the machine. The surface of this, visible to the user while the machine is in operation, is however limited so that the tables are often incomplete.

The machine illustrated in the drawings allows precisely this type of disadvantage to be overcome, while at the same time, providing an aesthetically pleasing appearance and an obvious practicality of use in the selection of the sewing patterns.

Figure 2:
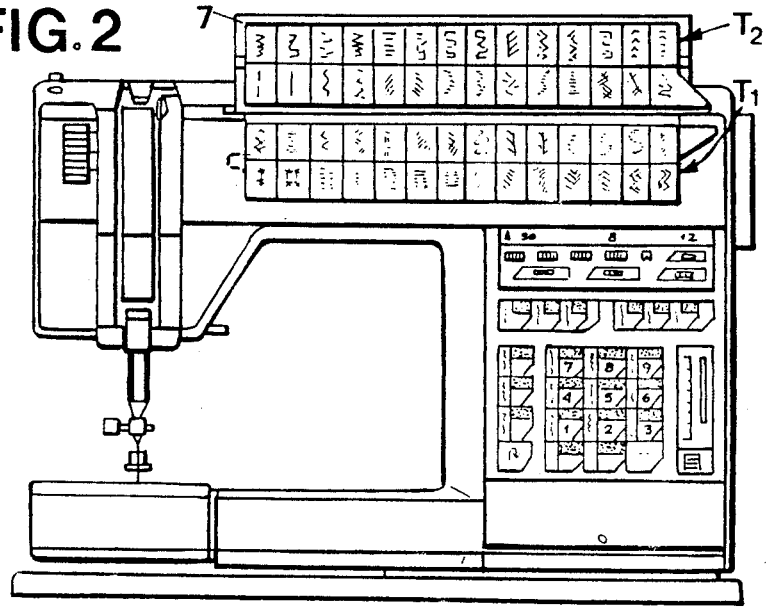
FIG. 2 is a view similar to that of FIG. 1, in another position of one of the components of the machine.
Figure 5:
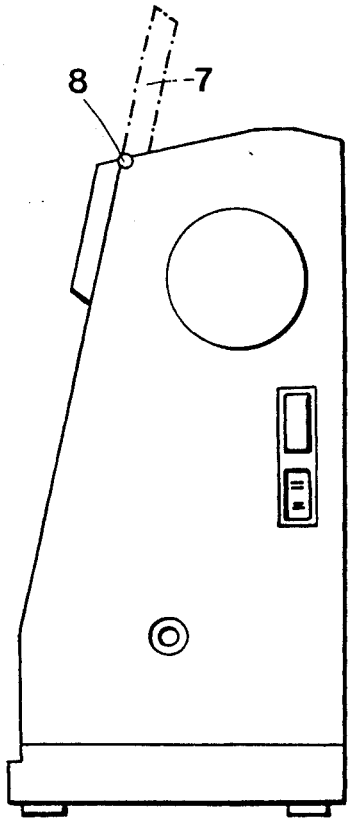
FIG. 5 is a side elevation of the machine.

Specifically, the machine according to the invention is equipped with a first table T1 (FIG. 2) formed by two superpositioned rows of ideograms, carried horizontally along the greater part of the length of the upper arm 4 of the casing of the machine, and a second table T2 located on the inside of a cover 7 (FIG. 2) hinged about an axis 8 (FIGS. 3 and 5) mounted at the top of the front face of the casing of the machine.

As shown in the drawings (FIGS. 1, 2, and 5), the cover 7 may be brought into two pivoted end positions. In the first position the cover is closed over or turned down onto the anterior or front surface of the casing of the machine, and it completely covers up the table T1 of ideograms ideograms. In the second position the cover is raised and slightly inclined towards the rear of the machine, and a user may see, along with the table T1, the ideograms contained in the aforementioned table T2.

Figure 3:
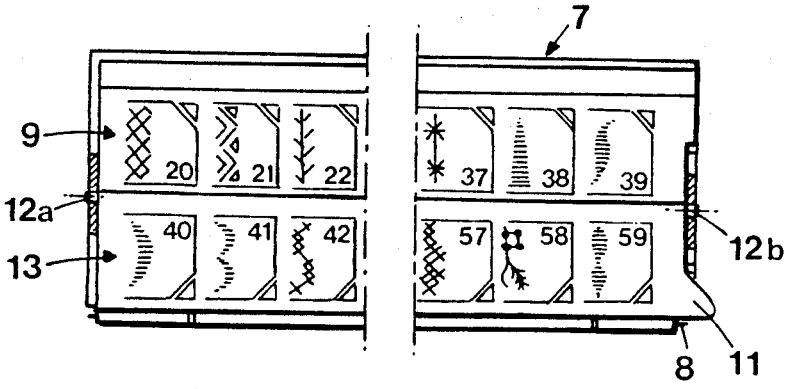
FIG. 3 is a detail view of FIG. 2, on a larger scale.
Figure 4:
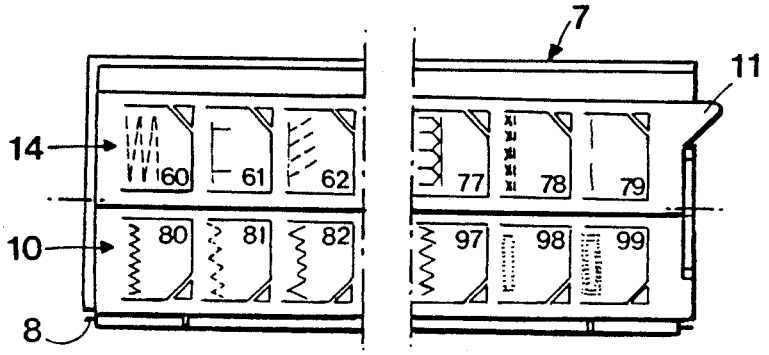
FIG. 4 is a view similar to that of FIG. 3, in another position of a component.

FIGS. 3 and 4 illustrate in detail the constituent elements or components of the table T2.

The bottom or base of the cover 7 is, in effect, provided with two rows 9 and 10 (FIGS. 3 and 4), parallel and adjacent, each row having the same number of ideograms, each ideogram representing a different type of sewing pattern capable of being carried out by the sewing machine. Each ideogram having a corresponding code, here of two digits, that the user must enter by activation of the keyboard CL when he/she wishes to proceed to the selection of that ideogram. In the drawings, each row 9 and 10 only comprises some 20 ideograms, it being understood however that this number is not limiting and that it only depends on the length that it is wished to give to the cover 7 and on the dimension and the arrangement chosen for the ideograms.

Between the rows 9 and 10 of ideograms carried by the bottom of the cover 7, a flap 11 is mounted from which the two ends of axes 12*a* and 12*b* project outwardly, extending parallel to the axis 8 and each pivoted in a corresponding opening in the side walls of the cover 7. Accordingly, flap 11 may be brought, by pivoting it, into two end positions in each of which it comes to rest on the bottom of the cover 7, covering up either the ideograms of the row 9 (FIG. 4) or those of the row 10 (FIG. 3).

As may be seen in the drawings, each surface of the flap 11 is, in turn, covered by a row 13, 14, respectively, of 20 ideograms corresponding to a total of 40 other types of different sewing patterns. The ideograms of the flap 11 are positioned, on each surface, in such a manner that in the one or the other of the two folded back positions of this (FIGS. 3 and 4), each ideogram of the flap finds itself precisely above a given ideogram belonging to the rows of ideograms 9 and 10 of the cover 7, in such a manner that whatever the position of the flap 11, the general appearance of the table T2 remains unchanged for the user.

Even though, on the drawings and in the foregoing description, reference has been made to a table T1 only comprising two super-positioned rows of ideograms marked on the casing itself of the sewing machine, or, as a variant, arranged on an intermediate support mounted on this casing, it is clear that such a table T1 may have another structure. It is possible, for example, to envisage complementing this table by joining a flap to it of the same nature and for the purposes as those of the flap with which the cover 7 is equipped.

Such a flap may then be hinged along an axis of pivoting which may be secured directly to the casing of the machine, for example, in the manner described in the Swiss Patent Application No. 1756/88, which may be referred to for more details.

It will easily be seen that the dimensions of such an assembly may be compatible with those of the cover 7 of the machine so that this may cover up everything in its closed over position of FIG. 1.

According to another manner of embodiment, not shown, the cover 7 may be mounted in a detachable manner so as to be replaceable, as required, by another cover of identical structure, but the bottom of which is covered with different types of ideograms; use may be made of this variant, in particular, in the case of use of the afore-mentioned slotted-in supplementary or additional memories.

It is also possible, for similar purposes, to provide for the detachable mounting of the flap 11.

The invention is not of course limited to that which has been shown and described. In particular, it is to be understood that it may very well be adapted to a sewing machine the keyboard of which has a different structure to that proposed here. For example, the keyboard may only comprise two or three keys directed to controlling, by repeated activation of each of them, the incrementing, by a corresponding number, of indicator elements for units, tens and hundreds, with a view to forming a number corresponding to that of a code characteristic of the desired pattern. Another key would allow entry of this number into memory and thus selection of the part of the memory relating to the desired pattern.

We claim:

1. A sewing machine, the casing of which has a lower arm, an upper arm and a pillar connecting the lower and upper arms, comprising:

a first plurality of ideograms carried on at least a part of a front face of the upper arm, said first plurality of ideograms being characteristic of a corresponding number of different stitches capable of being carried out by the sewing machine;

a cover pivotally mounted about an axis on the upper arm substantially parallel to the longitudinal axis of the upper arm, said cover being capable of either being closed over onto said upper arm or of being brought into a raised position, distant from the upper arm, at least a part of the surface of said cover being visible from the front of the machine when in the raised position distant from the upper arm, the axis of said cover being disposed so that said cover conceals the ideograms carried by said upper arm with the cover being in the closed over position;

a second plurality of ideograms carried on said cover and being arranged in two parallel rows and being representative of other stitches capable of being carried out by the sewing machine; and a hinged flap mounted in an opening in the cover, between the two parallel rows of ideograms, said flap being capable of being pivotally folded over on the bottom of the cover into two end positions in which said flap screens one or the other of said two parallel rows of ideograms depending on the end position of said flap, the two surfaces of said flap each carrying at least another row of ideograms relating to sewing stitches capable of being carried out by the sewing machine.

2. A sewing machine according to claim 1, said first plurality of ideograms including at least two parallel rows of ideograms; and said sewing machine further comprising a second hinged flap having at least two other rows of ideograms carried on first and second surfaces, said second hinged flap being mounted between said at least two parallel rows of ideograms of said first plurality of ideograms, said second hinged flap being capable of being brought into two pivotal end positions in each of which it masks respectively the first and second of said at least two parallel rows of ideograms of said first plurality of ideograms.

3. A sewing machine according claim 1, said flap being detachably mounted and being interchangeable with another flap.

4. A sewing machine according to claim 1, said cover being detachably mounted and being interchangeable with another cover.

* * * * *